US006000733A

United States Patent [19]

Linder

[11] Patent Number: 6,000,733

[45] Date of Patent: Dec. 14, 1999

[54] PRESSER BAR MECHANISM

[75] Inventor: John P. Linder, Orange, Calif.

[73] Assignee: International Door Closers, Inc., Anaheim, Calif.

[21] Appl. No.: 08/936,757

[22] Filed: Sep. 25, 1997

[51] Int. Cl.[6] ..... E05C 9/04

[52] U.S. Cl. ..... 292/92; 292/21

[58] Field of Search ..... 292/92, 93, 21, 292/34, 36, 46, 48; 70/92

[56] References Cited

U.S. PATENT DOCUMENTS

| | | | |
|---|---|---|---|
| 1,630,141 | 5/1927 | Soemer . | |
| 2,824,440 | 2/1958 | Jewett et al. | 292/92 |
| 3,123,387 | 3/1964 | Jackson . | |
| 3,614,145 | 10/1971 | Zawadzki | 292/92 |
| 3,663,047 | 5/1972 | Zawadzki | 292/92 |
| 3,730,574 | 5/1973 | Zawadzki | 292/92 |
| 3,767,238 | 10/1973 | Zawadzki | 292/92 |
| 3,801,144 | 4/1974 | Diehl | 292/92 |
| 3,819,213 | 6/1974 | Vanderburgh | 292/21 |
| 4,083,590 | 4/1978 | Folger | 292/92 |
| 4,145,900 | 3/1979 | Ohno | 70/92 |
| 4,167,280 | 9/1979 | Godec et al. | 292/92 |
| 4,295,673 | 10/1981 | Miller | 292/21 |
| 4,387,917 | 6/1983 | Cocker | 292/40 |
| 4,906,034 | 3/1990 | Verslycken | 292/92 |
| 4,961,330 | 10/1990 | Evans | 292/21 |
| 4,976,476 | 12/1990 | Cross et al. | 292/92 |
| 5,085,475 | 2/1992 | Austin et al. | 292/22 |
| 5,088,786 | 2/1992 | Linder | 292/92 |
| 5,169,185 | 12/1992 | Slaybaugh et al. | 292/92 |

FOREIGN PATENT DOCUMENTS

| | | |
|---|---|---|
| 0 233 094 A1 | 8/1987 | European Pat. Off. . |
| 0 307 088 A1 | 3/1989 | European Pat. Off. . |
| 0 481 931 A1 | 4/1992 | European Pat. Off. . |
| 479378 | 2/1938 | United Kingdom . |
| 519937 | 2/1940 | United Kingdom . |
| 656407 | 8/1951 | United Kingdom . |
| 1451078 | 9/1972 | United Kingdom . |
| 2028909A | 3/1980 | United Kingdom . |
| 1 579 921 | 11/1980 | United Kingdom . |
| 2 284 445 | 6/1995 | United Kingdom . |

*Primary Examiner*—Flemming Saether
*Assistant Examiner*—Gary Estremsky
*Attorney, Agent, or Firm*—Pretty, Schroeder & Poplawski, P.C.

[57] ABSTRACT

A presser bar mechanism for an exit door having a frame with a stile, upper and lower lock rods vertically sliding in the stile, a presser bar carried on the door frame, a plate mounted in the stile for rotation about a horizontal axis, upper and lower connectors each having a first end attached to the plate and each having a second end attached to said upper and lower lock rods, respectively, a drive pin carried in one of the connectors and projecting outward from the stile, a slide housing carried on the stile and including a slide channel, a slide member carried in the slide housing for translation along the slide channel, and a crank carried in the slide housing and having first and second crank arms, with the first crank arm engageable by the presser bar and with the second crank arm engagable with the slide member so that pressing on the presser bar rotates the crank to move the slide member in the slide housing, with the slide member engaging the drive pin in driving relation to translate the drive pin and rotate the plate and translate the lock rods in the stile when the presser bar is pressed.

4 Claims, 4 Drawing Sheets

PRESSER BAR MECHANISM

BACKGROUND OF THE INVENTION

This invention relates to exit doors with presser bars and in particular to a new and improved operating mechanism for the door. A typical exit door has a horizontal bar mounted on the door by lever arms, and one such design is shown in U.S. Pat. No. 5,088,786.

In another type of exit door, a horizontal presser bar is utilized rather than a horizontal lever, and one such product is shown in U.K. publication GB 2,284,445 A.

A disadvantage of the prior art flat presser bar designs is the relatively large number of parts in the prior flat bar constructions which increases the possibility of defects and/or malfunction and difficulty in installation, and when not correctly aligned, cause functional problems.

SUMMARY OF THE INVENTION

A new and improved presser bar mechanism for an exit door having a frame with a stile, upper and lower lock rods vertically sliding in the stile, a presser bar carried on the door frame, a plate mounted in the stile for rotation about a horizontal axis, upper and lower connectors each having a first end attached to the plate and each having a second end attached to said upper and lower lock rods, respectively, a drive pin carried in one of the connectors and projecting outward from the stile, the presser bar mechanism including a slide housing carried on the stile and including opposing sides defining a slide channel, a slide member carried in the slide housing for translation along the slide channel, and a crank carried in the slide housing and having first and second crank arms, with the first crank arm engageable by the presser bar and with the second crank arm engagable with the slide member so that pressing on the presser bar rotates the crank to move the slide member in the slide housing, with the slide member having a longitudinal slot for engaging the drive member in driving relation to translate the drive pin, rotate the plate, and translate the lock rods in the stile when the presser bar is pressed.

In the preferred embodiment of the invention, the drive member projects perpendicularly through the plane of the door for passing through the longitudinal slot in the slide member. Also the slide member includes a transverse plate for driving engagement by the second crank arm of the crank.

In particular, a feature of the invention permits both right hand and left hand installations, by providing a right hand crank and a left hand crank and first and second pairs of spaced opposing wings formed by the opposing sides of the slide housing for supporting either the right hand crank or the left hand crank, and with spaced transverse plates in the slide member, one for driving engagement with a right hand crank and one for driving engagement with a left hand crank. The manufacturer provides both a right hand and a left hand crank with the panic bar hardware, and the installer selects the desired crank for positioning in the appropriate location in the slide member. The other crank typically is discarded.

DESCRIPTION OF THE PREFERRED EMBODIMENT

Figure 1:
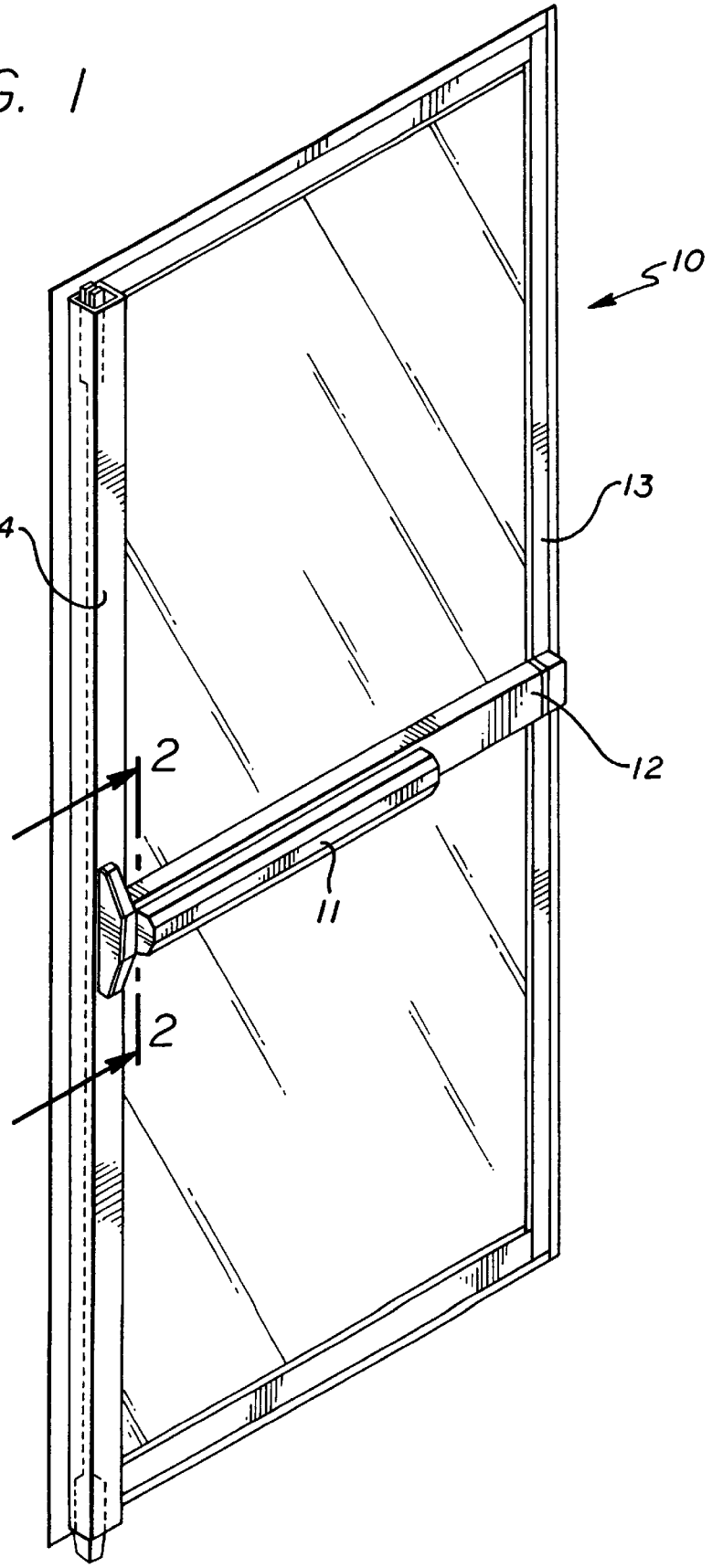
FIG. 1 is perspective view of an exit door incorporating the presently preferred embodiment of the invention.

An exit door 10 is shown in FIG. 1, with a presser bar 11 of the presser type carried on a frame 12 mounted on stiles 13, 14 respectively of the door frame.

Figure 2:
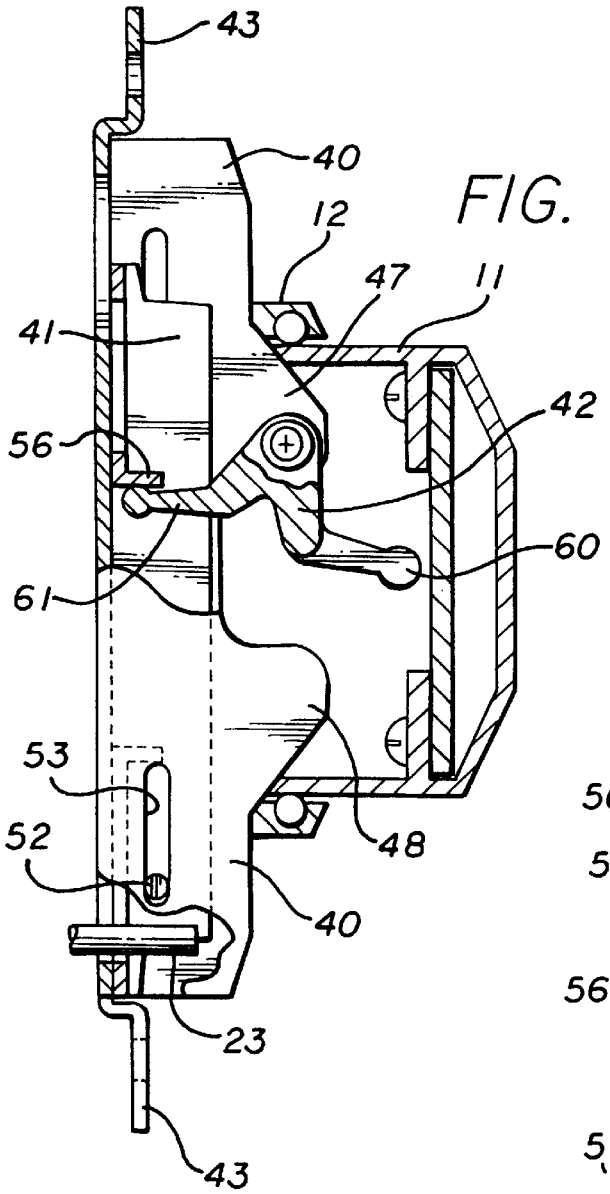
FIG. 2 is an enlarged partial sectional view taken along the line 2—2 of FIG. 1 showing the presser bar in the normal or extended position.
Figure 3:
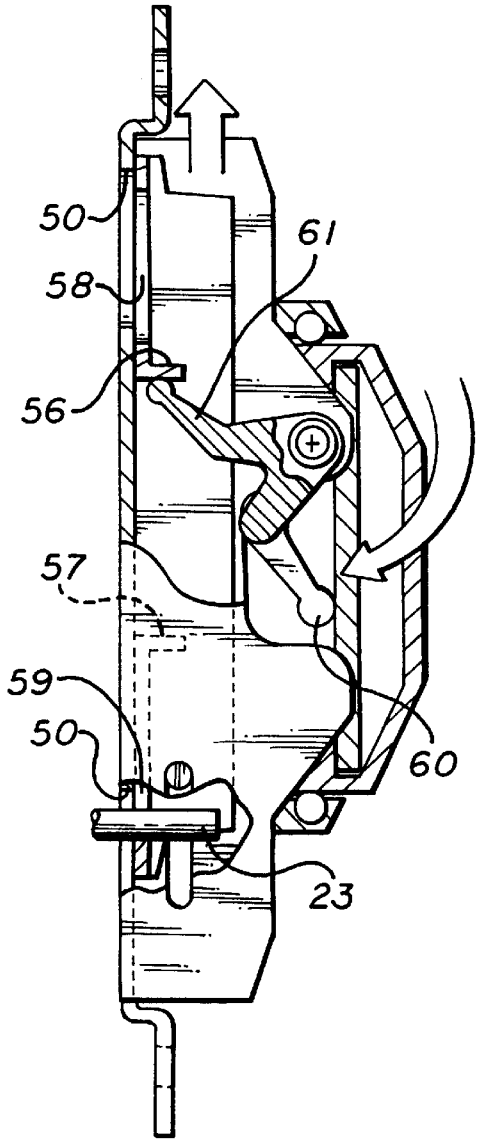
FIG. 3 is a view similar to that of FIG. 2 showing the presser bar in the pressed or door open position.
Figure 4:
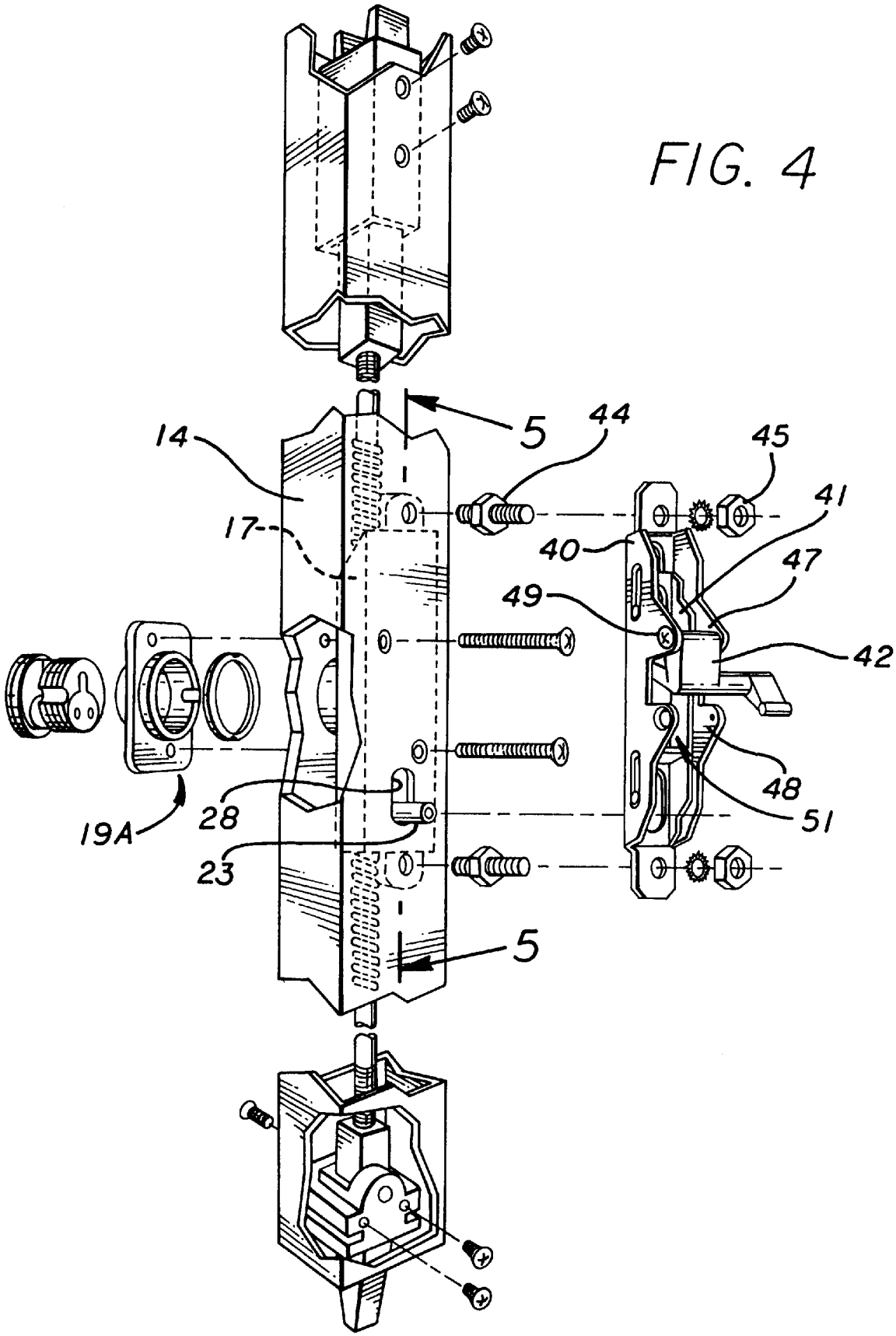
FIG. 4 is an exploded view showing details of the operating mechanism of the door.
Figure 5:
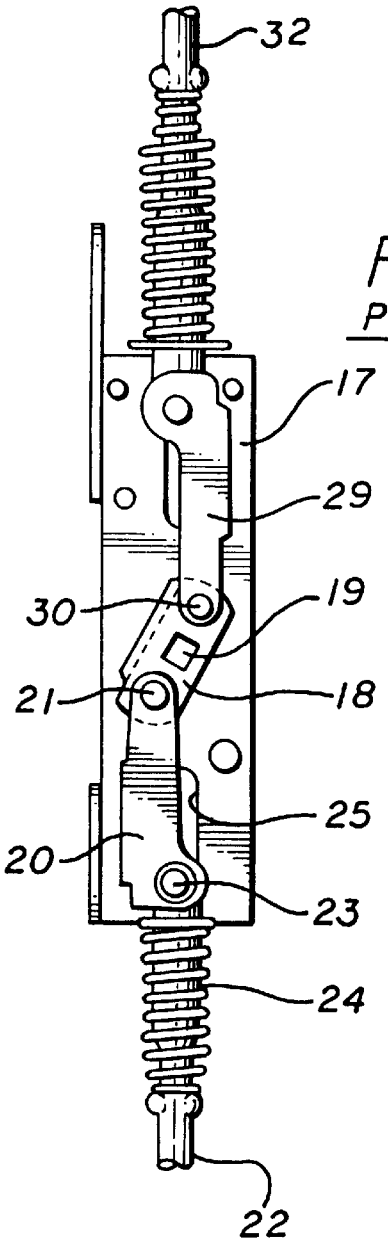
FIG. 5 PRIOR ART
FIG. 5 is a partial sectional view taken along the line 5—5 of FIG. 4.
Figure 6:
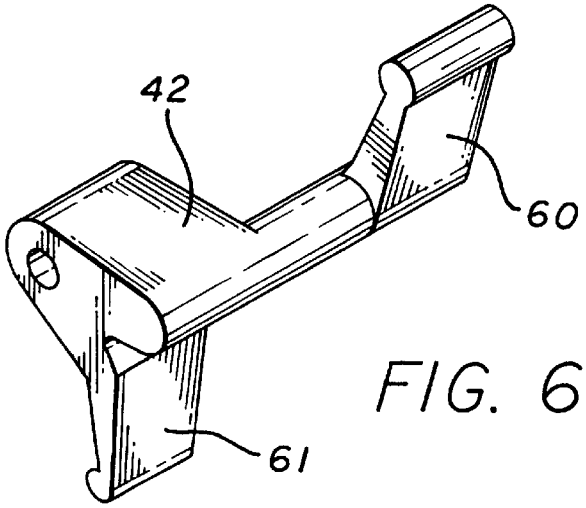
FIG. 6 is a perspective view of the crank for a right hand installation.
Figure 7:
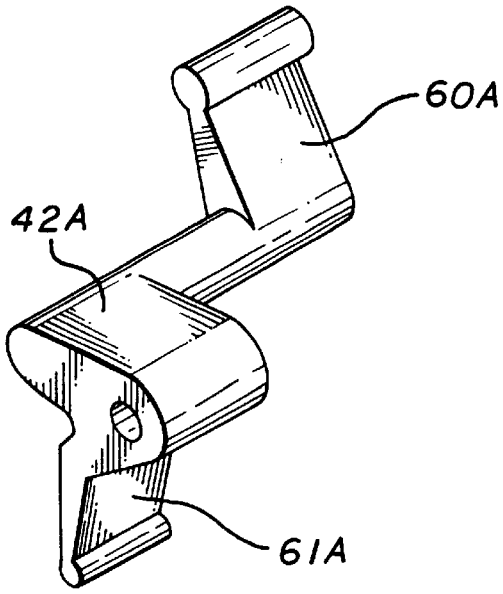
FIG. 7 is a view similar to that of FIG. 6 for a left hand installation.

The presser bar 11 slides horizontally in the frame 12 and is shown in the normal or locked position in FIG. 2 and in the pressed or door open position in FIG. 3. The presser bar construction is conventional and may be that shown in GB 2,284,445 A. As shown in FIGS. 4 and 5, a mechanism shell 17 is mounted in the stile 14 and a U-shaped plate 18 is mounted in the shell 17 for rotation on a horizontal axis about a shaft 19. A conventional key operated cylinder locking mechanism 19A shown generally can be incorporated for rotating the plate 18 if desired.

A U-shaped lower connector 20 is coupled to one end of the rotating plate 18 by a lower connecting pin 21, and is coupled to a lower lock rod 22 by a drive pin 23 which rides in a slot 24 in the rod. The drive pin 23 also rides in a shell slot 25 in the shell 17. The drive pin 23 projects outward from the stile through a stile slot 28 and serves as a drive pin or drive member for the door unlocking mechanism.

An upper connector 29 is connected to the plate 18 by an upper pin 30, and is coupled to an upper lock rod 32. The construction and operation of the lower and upper connectors and lower and upper lock rods are conventional. The design of the U.S. Pat. No. 5,088,786 may be utilized.

The new features of the present invention include a slide housing 40, a slide member 41, and a crank 42. The slide housing 40 is mounted on the exterior of the stile 14 with mounting tabs 43, mounting bolts 44 and mounting nuts 45. The slide housing 40 preferably is U-shaped, with a first pair of spaced opposing sides 47 and a second pair of spaced opposing side 48. In the embodiment illustrated, the crank 42 is mounted between the opposing sides 47 with a screw 49. This configuration is usable with a right hand door. For a left hand installation, crank 42A is utilized, positioned between the opposing side 48. Clearance slots 50 are provided in the slide housing 40 for the drive pin 23.

The slide member 41 also preferably is U-shaped for sliding in a slide channel 51 formed by the U-shaped slide housing. Guide pins 52 are carried in the slide member and ride in guide slots 53 in the slide housing for guiding the sliding movement of the slide member in the slide housing. In the embodiment illustrated, two such guide pins and two slots are utilized.

An upper transverse plate 56 is provided in the slide member 41 toward the upper end, and a similar lower transverse plate 57 is provided toward the lower end. A longitudinal slot 58 is provided in the slide member above the upper transverse plate 56, and a similar longitudinal slot 59 is provided below the lower transverse plate 57. The slots 58 and 59 permit the slide member to be non-handed.

The crank 42 has a first crank arm 60 which is engageable by the presser bar 11, and a second crank arm 61 which engages the slide member at the upper transverse plate 56.

In a variation where the crank 42A is utilized, the crank arm 60A is engaged by the presser bar and the crank arm 61A engages the lower transverse plate 57 of the slide member.

In operation, the panic bar mechanism is normally in the position shown in FIG. 2. The lock rods are extended and the door is in the closed position. A conventional dogging mechanism may be used to maintain the door unlocked while in the closed position, if desired. The door opening mechanism is actuated by pressing on the presser bar 11, which moves the bar from the position of FIG. 2 to the position of FIG. 3. The presser bar engages the crank arm 60, rotating the crank clockwise as shown in FIG. 3. The crank arm 61 engages the upper transverse plate 56 of the slide member and moves the slide member upward, as shown in FIG. 3.

The slide member 41 engages the drive pin 23 to move the pin upward, which rotates the plate 18 clockwise as seen in FIG. 5. This rotation raises the lower lock rod and pulls the upper lock rod downward, to unlock the door, permitting the door to swing open under the pressure applied by the user at the presser bar.

The compact and modern appearance of the present design facilitates its use and acceptance in present day architectural specifications. The design has the additional advantage of extending less into the clear opening of the door in its open position.

I claim:

1. A presser bar mechanism for use with an exit door, the exit door having a frame with a stile, the presser bar mechanism comprising:

a slide housing for mounting on the stile, said slide housing including spaced opposing sides defining a slide channel;

a presser bar for slidably mounting on the frame, said presser bar slidably mounted to said slide housing for linear sliding movement relative to said slide housing;

upper and lower lock rods for vertical sliding in the stile;

a plate for mounting in the stile, said plate rotatable about a horizontal axis;

upper and lower connectors for vertical movement in the stile, each connector having a first end attached to said plate and each connector having a second end attached to said upper and lower lock rods, respectively;

a drive pin mounted to one of said connectors, said drive pin mounted perpendicularly relative to said connector and said drive pin for projection outward from the stile;

a slide member carried on said slide housing for translation along said slide channel, said slide member having a longitudinal slot for engaging said drive pin; and a crank pivotably mounted in said slide housing between said spaced opposing sides, said crank having a first crank arm and a second crank arm, said first crank arm for engagement by said presser bar and said second crank arm for engagement with said slide member so that pressing on said presser bar moves said presser bar linearly relative to said slide housing, said presser bar contacting an end of said first crank arm for a sliding cam engagement to cause said crank to rotate such that said slide member moves in said slide housing translating said drive pin and rotating said plate causing said upper and lower lock rods to translate.

2. The presser bar mechanism of claim 1, said slide member further comprising a transverse plate, said transverse plate engageable by said second crank arm.

3. A presser bar mechanism for use with an exit door, the exit door having a frame with a stile, the presser bar mechanism comprising:

a presser bar for mounting on the frame;

upper and lower lock rods for vertical sliding in the stile;

a plate for mounting in the stile, said plate rotatable about a horizontal axis;

upper and lower connectors for vertical movement in the stile, each connector having a first end attached to said plate and each connector having a second end attached to said upper and lower lock rods, respectively;

a drive pin mounted to one of said connectors, said drive pin mounted perpendicularly relative to said connector and said drive pin for projection outward from the stile;

a slide housing, for mounting on the stile, said slide housing including spaced opposing sides defining a slide channel;

a slide member carried on said slide housing for translation along said slide channel, said slide member having a longitudinal slot for engaging said drive pin; and a crank mounted in said slide housing between said spaced opposing sides, said crank having a first crank arm and a second crank arm, said first crank arm for engagement by said presser bar and said second crank arm engageable with said slide member so that pressing on said presser bar rotates said crank such that said slide member moves in said slide housing translating said drive pin and rotating said plate causing said upper and lower lock rods to translate;

wherein said opposing sides have a first pair of spaced opposing wings for right handed mounting of said crank and a second pair of spaced opposing wings for left handed mounting of said crank in said slide housing; and said slide member further comprises an upper transverse plate adjacent to said first pair of spaced opposing wings engageable by said second crank arm, and a lower transverse plate adjacent to said second pair of spaced opposing wings engageable by said second crank arm.

4. An exit door comprising:

a frame with a stile;

a slide housing for mounting on said stile, said slide housing including spaced opposing sides defining a slide channel;

a presser bar slidably mounted on said frame, said presser bar slidably mounted to said slide housing for linear sliding movement relative to said slide housing;

upper and lower lock rods vertically slidable in said stile;

a plate mounted in said stile, said plate rotatable about a horizontal axis;

upper and lower connectors vertically moveable in said stile, each connector having a first end attached to said plate and each connector having a second end attached to said upper and lower lock rods, respectively;

a drive pin mounted to one of said connectors, said drive pin mounted perpendicularly relative to said connector and said drive pin projecting outwardly from said stile;

a slide member carried on said slide housing for translation along said slide channel, said slide member having a longitudinal slot for engaging said drive pin; and a crank pivotably mounted in said slide housing between said spaced opposing sides, said crank having a first crank arm and a second crank arm, said first crank arm for engagement by said presser bar and said second crank arm for engagement with said slide member so that pressing on said presser bar moves said presser bar linearly relative to said slide housing, said presser bar contacting an end of said first crank arm for a sliding cam engagement to cause said crank to rotate such that said slide member moves in said slide housing translating said drive pin and rotating said plate causing said upper and lower lock rods to translate.

* * * * *

UNITED STATES PATENT AND TRADEMARK OFFICE

CERTIFICATE OF CORRECTION

PATENT NO. : 6,000,733

DATED : December 14, 1999

INVENTOR(S) : John P. Linder

It is certified that error appears in the above-identified patent and that said Letters Patent is hereby corrected as shown below:

| COL | LINE | DESCRIPTION OF ERROR |
|---|---|---|
| 4 | Claim 3, 13 | after "a slide housing", delete "," |

Signed and Sealed this

Twenty-sixth Day of December, 2000

*Attest:*

Q. TODD DICKINSON

*Attesting Officer*

*Director of Patents and Trademarks*